US008328529B2

(12) United States Patent
Thompson et al.

(10) Patent No.: US 8,328,529 B2
(45) Date of Patent: Dec. 11, 2012

(54) SYSTEM, METHOD AND APPARATUS FOR ELECTRICAL SUBMERSIBLE PUMP ASSEMBLY WITH PUMP DISCHARGE HEAD HAVING AN INTEGRALLY FORMED DISCHARGE PRESSURE PORT

(75) Inventors: Joseph Scott Thompson, Owasso, OK (US); Kevin R. Bierig, Tulsa, OK (US); Robert H. McCoy, Talala, OK (US); Gordon Lee Besser, Claremore, OK (US); Dick L. Knox, Claremore, OK (US); Joo Tim Ong, Houston, TX (US); Suresha R. O'Bryan, Joplin, MO (US); Dustin B. Campbell, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 904 days.

(21) Appl. No.: 12/362,557

(22) Filed: Jan. 30, 2009

(65) Prior Publication Data

US 2009/0196774 A1 Aug. 6, 2009

Related U.S. Application Data

(60) Provisional application No. 61/025,927, filed on Feb. 4, 2008.

(51) Int. Cl.
*F04B 49/00* (2006.01)

(52) U.S. Cl. ..... 417/63

(58) Field of Classification Search ..... 417/63, 417/415

See application file for complete search history.

(56) References Cited

U.S. PATENT DOCUMENTS

| | | | | |
|---|---|---|---|---|
| 3,094,874 | A * | 6/1963 | Rolle | 73/299 |
| 4,741,208 | A | 5/1988 | Vandevier | |
| 5,050,092 | A | 9/1991 | Perry | |
| 6,126,392 | A | 10/2000 | Sabini | |
| 6,536,271 | B1 | 3/2003 | Gopalakrishnan et al. | |
| 6,981,838 | B2 | 1/2006 | McKee et al. | |
| 2003/0056956 | A1 * | 3/2003 | Collie et al. | 166/336 |
| 2006/0266913 | A1 * | 11/2006 | McCoy et al. | 248/550 |
| 2007/0114040 | A1 | 5/2007 | Jamieson et al. | |
| 2007/0128057 | A1 * | 6/2007 | Ewing | 417/422 |
| 2007/0289747 | A1 * | 12/2007 | Shaw et al. | 166/368 |

* cited by examiner

*Primary Examiner* — Anh Mai
*Assistant Examiner* — Hana Featherly
(74) *Attorney, Agent, or Firm* — Bracewell & Giuliani LLP

(57) ABSTRACT

An electrical submersible pump assembly has a pump discharge head with an integrally formed pump discharge pressure port. The discharge head is mounted directly to the pump and couples the pump to production tubing. A static pressure port extends directly through the side wall of the discharge head. The pressure port includes a tubing connector for hydraulic tubing to run down to the gauge. Inside the discharge head, a flow limiter is located in the pressure port to stop the loss of fluid if there is a break in the tubing connector or hydraulic line. Alternatively, the discharge head may incorporate a venturi or other pressure drop structure to allow the fluid flow to be measured via a pressure drop across an orifice. The venturi may be configured as an insert to permit it to be replaced after it has become worn by abrasive flow.

17 Claims, 6 Drawing Sheets

SYSTEM, METHOD AND APPARATUS FOR ELECTRICAL SUBMERSIBLE PUMP ASSEMBLY WITH PUMP DISCHARGE HEAD HAVING AN INTEGRALLY FORMED DISCHARGE PRESSURE PORT

This application claims priority to and the benefit of U.S. Provisional Patent Application No. 61/025,927, which was filed on Feb. 4, 2008, and is incorporated herein by reference in its entirety.

BACKGROUND OF THE INVENTION

1. Technical Field

The present invention relates in general to electrical submersible pump assemblies and, in particular, to an improved system, method, and apparatus for an electrical submersible pump assembly having a pump discharge head with an integrally formed pump discharge pressure port.

2. Description of the Related Art

In electrical submersible pump assemblies (ESP), many types of gauges are used to monitor well conditions and pump performance at the bottom of a well. The gauges are typically grouped in a single location (e.g., below the motor) so that all signal conductors for the gauges and the power and/or other conductors for the motor may be combined in a single conduit that extends from the ESP to the surface of the well.

The discharge pressure of the pump is measured by one of the gauges, such as a hydraulic gauge, located below the motor on the bottom of the ESP for the reason described above. However, the pump discharges fluid above the remaining assembly, which is spaced a significant distance apart from the bottom of the motor. Thus, the discharge pressure must be communicated from the pump discharge via a hydraulic line to the hydraulic gauge at the lower end of the ESP. This hydraulic line is used to transmit the static fluid pressure to the gauge so that the pressure at the discharge of the pump may be measured.

Conventional solutions for this requirement typically address the problem by including a separate discharge tubing sub or a Y-tool 31 (see, e.g., FIG. 3) as an additional component between a pump assembly 33 and the production tubing 35. These separate and additional devices are mounted to the pump discharge and tubing and add cost and complexity to the overall system. Although known solutions are workable, an improved solution that overcomes the limitations of the prior art would be desirable.

SUMMARY OF THE INVENTION

Embodiments of a system, method, and apparatus for an electrical submersible pump assembly having a pump discharge head with an integrally formed pump discharge pressure port are disclosed. The pump discharge head or sub may be mounted directly to the pump and couples the pump to production tubing. A hydraulic discharge or static pressure port extends directly through the side wall of the pump discharge head so no additional sub or tool is required to be attached to or between the discharge end of pump and the production tubing. The pressure port may include a tubing connector that allows the hydraulic tubing to be connected thereto and run down to the gauge. Inside the discharge head, a flow limiter may be located in the pressure port to stop the loss of fluid through the port if a break in the tubing connector or hydraulic line.

In other embodiments, the discharge head may incorporate a venturi device or other pressure drop structure to allow the fluid flow to be measured via a pressure drop across an orifice. The venturi may be configured as an insert to permit it to be replaced after it has become worn by abrasive flow.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail a more particular description of the invention may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Referring to FIGS. 1, 2 and 4-8, embodiments of a system, method, and apparatus for an electrical submersible pump (ESP) assembly having a pump discharge head with an integrally formed pump discharge pressure port. Sensors may be used integrally within the pump head and communicated to an ESP control and communications system on gauge system, or to the surface via TEC wire or hydraulic tubing.

Figure 1:
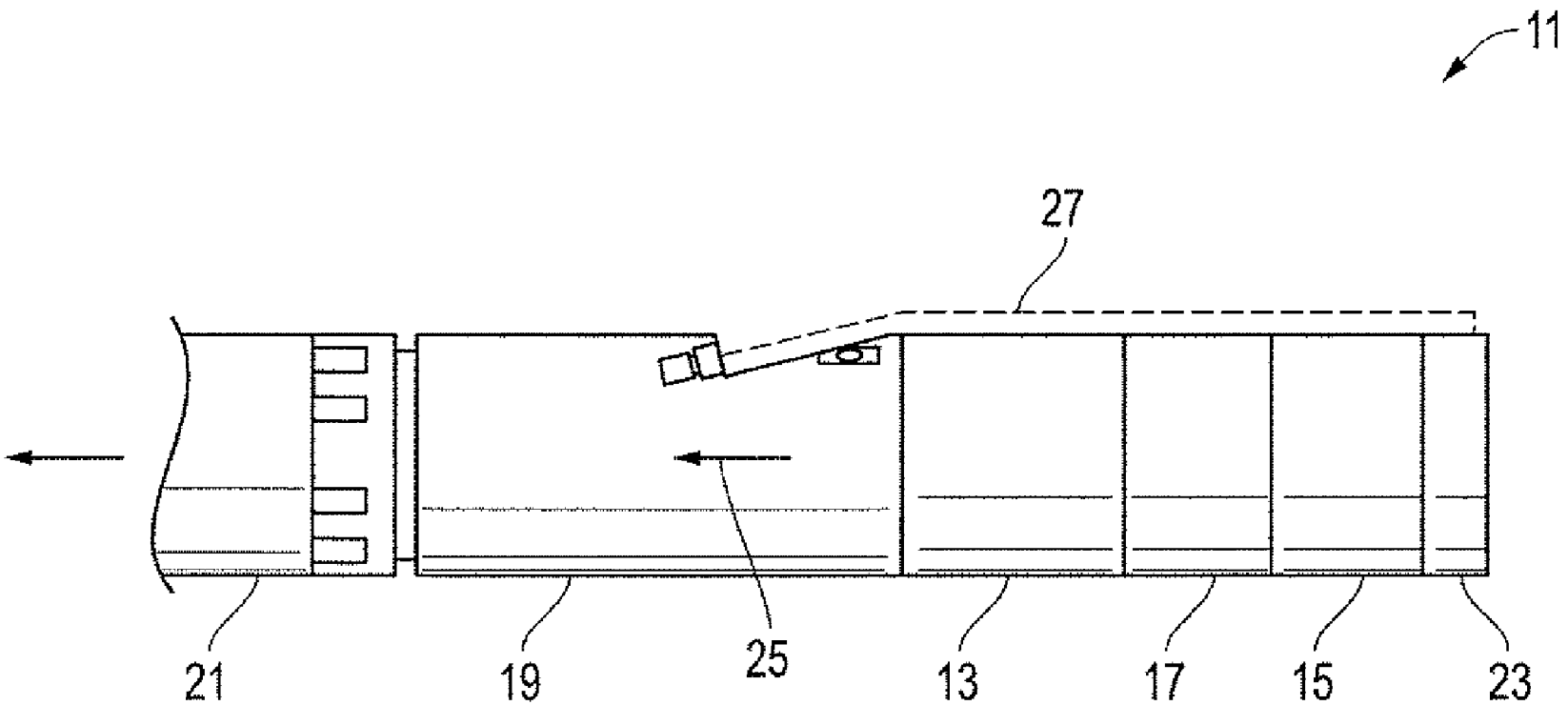
FIG. 1 is a schematic side view of one embodiment of an electrical submersible pump assembly mounted to a tubing string and is constructed in accordance with the invention.

FIG. 1 depicts one embodiment of electrical submersible pump assembly (ESP) 11 comprises a centrifugal pump 13, a motor 15 and a seal assembly 17 located between the pump 13 and motor 15. A pump discharge head or sub 19 is mounted directly to the pump 13 and couples the pump 13 to a string of production tubing 21. Pump discharge head 19 is threaded to pump 13, and may be threaded or bolted to tubing 21, depending on the application.

Gauges 23 are used with the ESP 11 for monitoring well conditions and pump performance at the bottom of the well. Gauges 23 are typically grouped in a single location (e.g., below motor 15) so that all signal conductors for the gauges 23 and the power and/or other conductors for motor 15 may be combined in a single conduit that extends from the ESP 11 to the surface of the well.

In some applications, the discharge pressure (see, e.g., arrow in FIG. 1) of the pump 13 is measured by one of the gauges 23. The discharge pressure is communicated from the pump discharge via a hydraulic line 27 to a hydraulic gauge 23 at the lower end of the ESP 11. This hydraulic line 27 is used to transmit the static fluid pressure to the gauge 23 so that the pressure at the discharge of the pump 13 may be measured.

Figure 2:
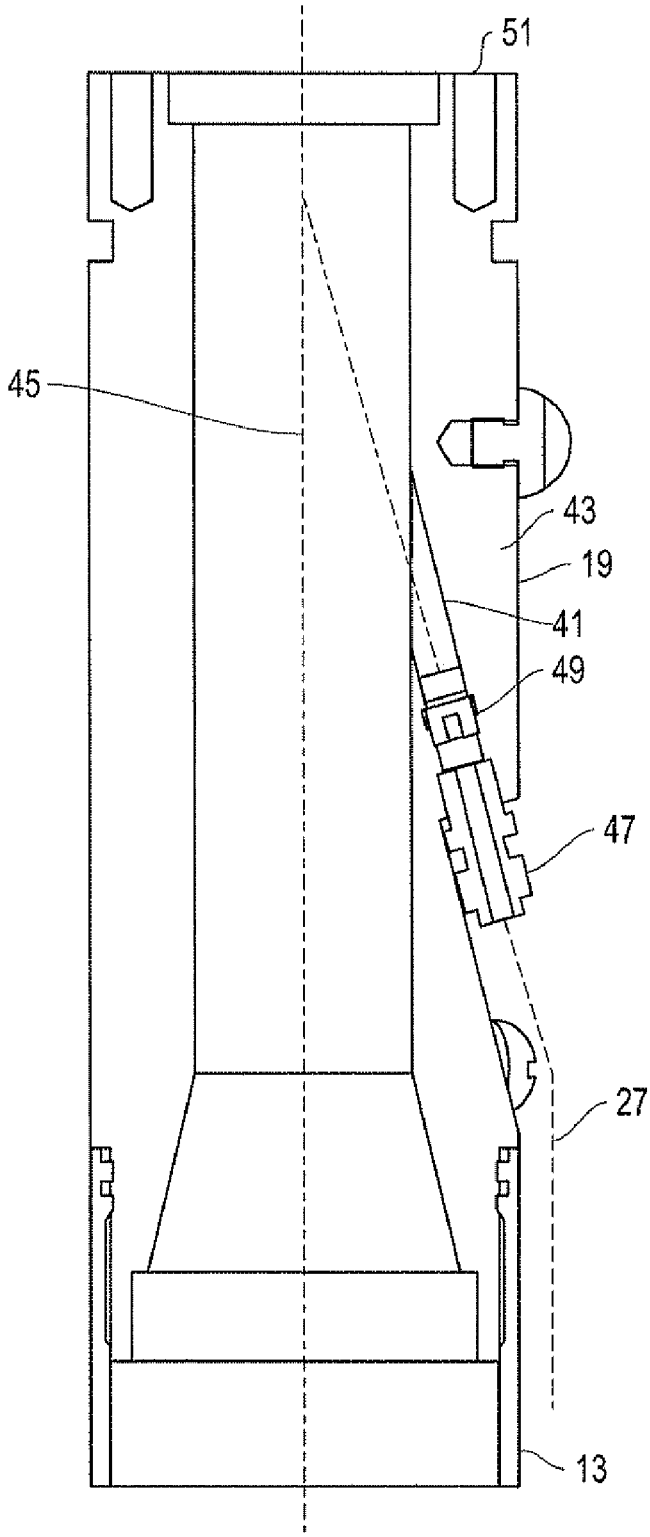
FIG. 2 is an enlarged sectional side view of one embodiment of a centrifugal pump discharge head utilized by the assembly of FIG. 1 and is constructed in accordance with the invention.
Figure 3:
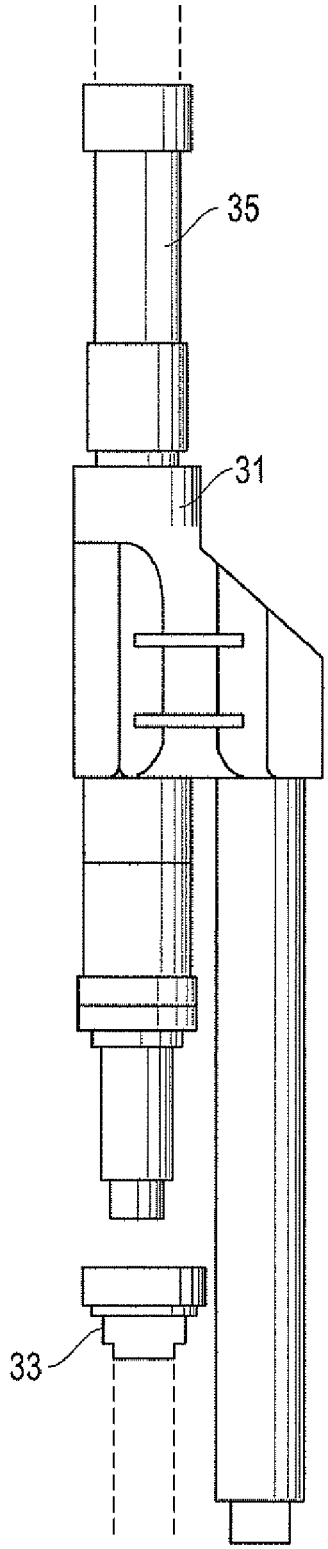
FIG. 3 (Prior Art)
FIG. 3 is a side view of a conventional pump discharge pressure component.

Referring now to FIG. 2, some embodiments of the invention overcome the limitations of the prior art by integrating a hydraulic discharge or static pressure port 41 directly through the side wall 43 of the pump discharge head 19. As a result no additional sub or tool is required to be attached to or between the discharge end of pump 13 and the production tubing. In one embodiment, the pressure port 41 on the discharge head 19 includes a tubing connector 47 that allows the hydraulic tubing 27 to be connected thereto and run down to the gauge 23 (FIG. 1). In one embodiment, the pressure port 41 extends at a shallow acute angle (e.g., 20 degrees) relative to a longitudinal axis 45 of the discharge head 19. However, other angles of inclination also may be used.

Inside the discharge head 19, a flow limiter 49 is located in the pressure port 41 to stop the loss of fluid through port 41 if a break in the tubing connector 47 or hydraulic line 27 should occur. This design eliminates the need to remove the pump string for repairs. Although the axial end 51 of the discharge head 19 is shown in a bolt-on configuration for production tubing 21, a threaded configuration may be provided.

Figure 4:
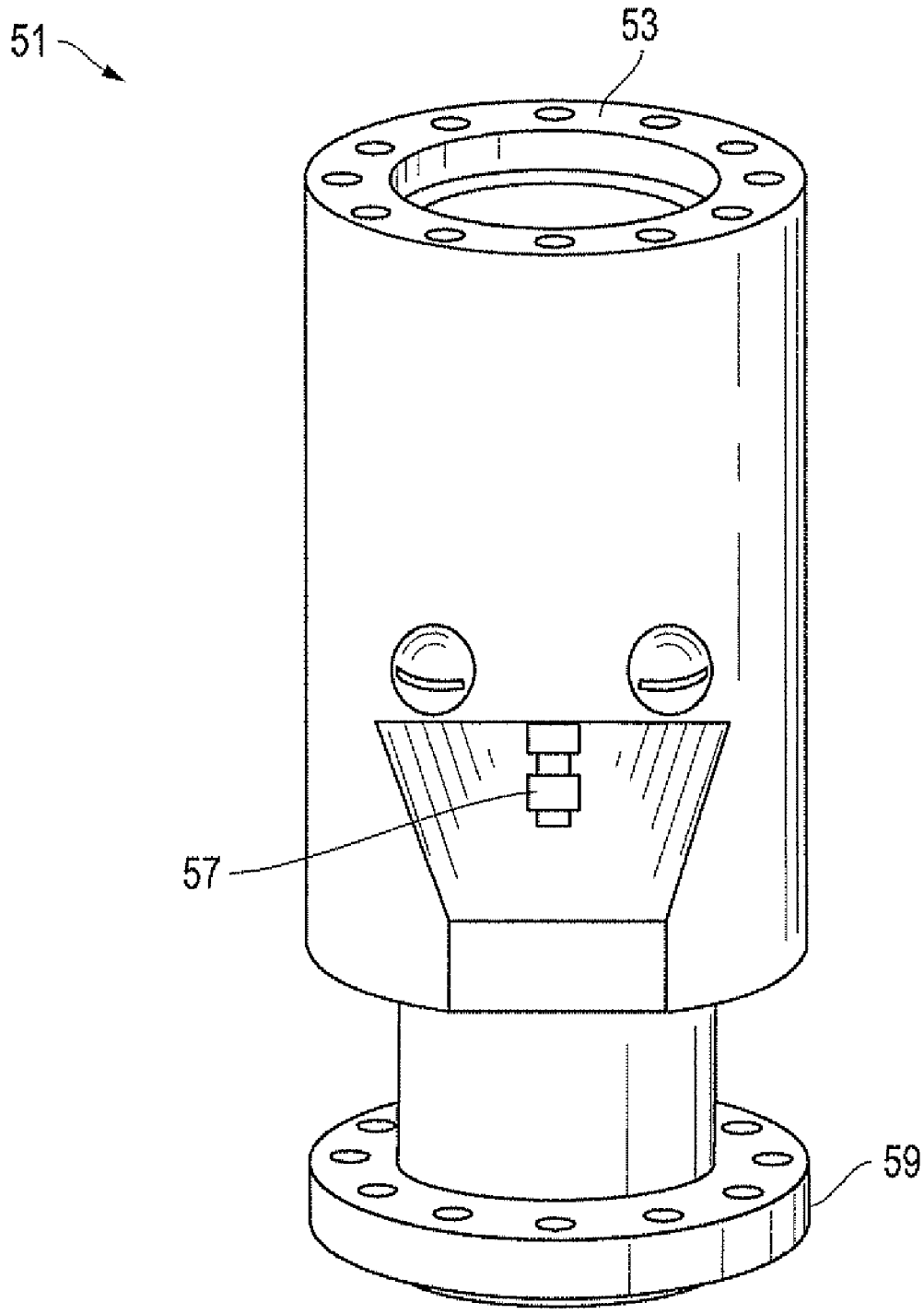
FIG. 4 is an isometric view of another embodiment of a pump discharge head constructed in accordance with the invention.

Referring now to FIG. 4, another embodiment of a pump discharge head 51 is shown and is constructed in accordance with the invention. Discharge head 51 also integrates a hydraulic discharge or static pressure port directly through its side wall 53 so that no additional sub or tool is required to be attached to or between the discharge end of the pump and the production tubing. The pressure port on discharge head 51 may include a tubing connector 57 that allows the hydraulic tubing to be connected thereto and run down to a gauge. As with the previous embodiment, the pressure port may extends at an acute angle through side wall 53. Discharge head 51 also is configured with bolt-on connection features (e.g., flange 59) to secure it to the pump and production tubing.

Figure 5:
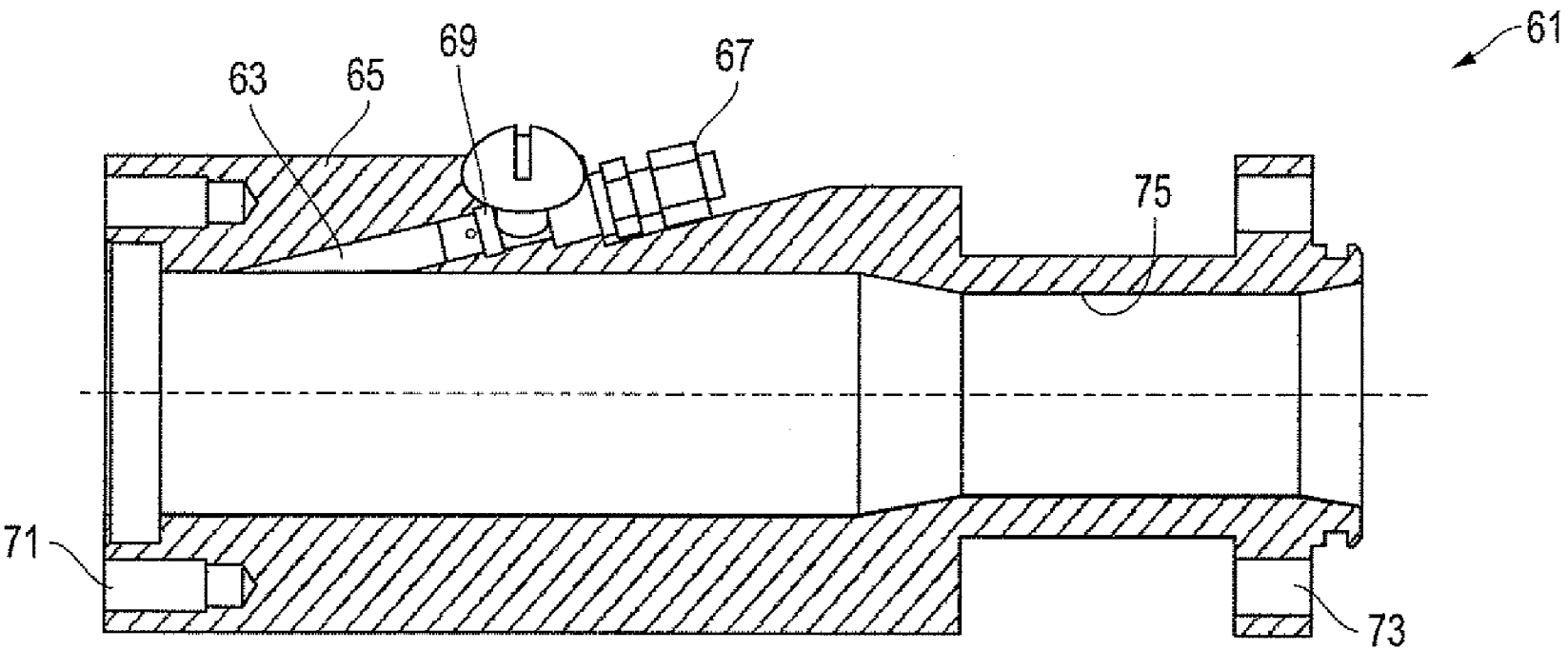
FIG. 5 is sectional side view of a third embodiment of a pump discharge head constructed in accordance with the invention.

Referring now to FIG. 5, another embodiment of a centrifugal pump discharge head 61 constructed in accordance with the invention is shown. Like the previous embodiments, discharge head 61 has an angled hydraulic discharge or static pressure port 63 directly through its side wall 65 so that no additional sub or tool is required to be attached to or between the discharge end of the pump and the production tubing. The pressure port 63 on discharge head 61 may include a flow limiter 69, a tubing connector 67 for hydraulic tubing, and bolt-on connection features 71, 73 as shown. Discharge head 61 also incorporates a venturi device 75, which allows the fluid flow to be measured via a pressure drop across an orifice. This embodiment integrates the venturi 75 directly into the discharge head 61 instead of requiring a separate component for that purpose. Structures other than a venturi for causing a change in pressure also may be used, such as an orifice plate, flow nozzle, etc. Alternatively, the structure also may incorporate any change in the internal diameter of the discharge sub and utilize a high resolution, differential pressure sensor or an absolute pressure sensor.

Figure 6:
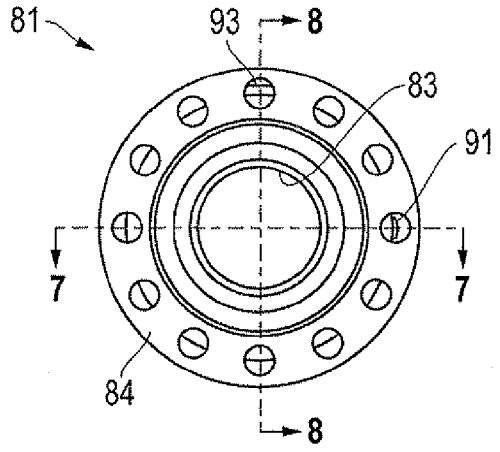
FIG. 6 is an end view of a fourth embodiment of a pump discharge head constructed in accordance with the invention.
Figure 7:
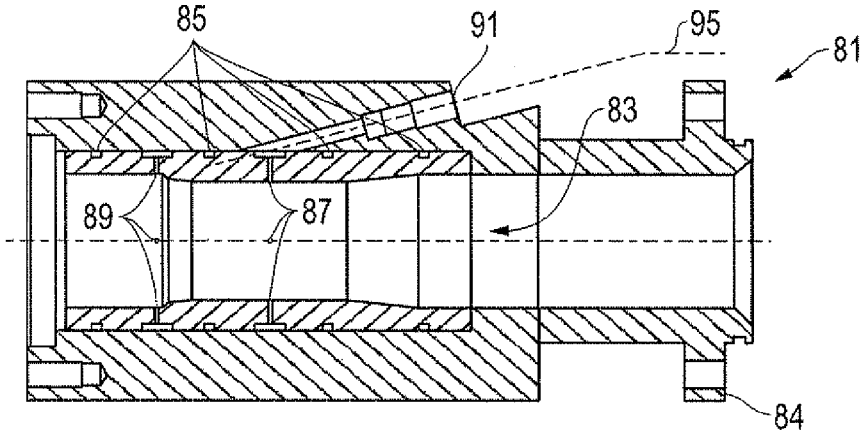
FIGS. 7 and 8 are sectional side views of the head of FIG. 6 taken along the lines 7-7 and 8-8, respectively.
Figure 8:
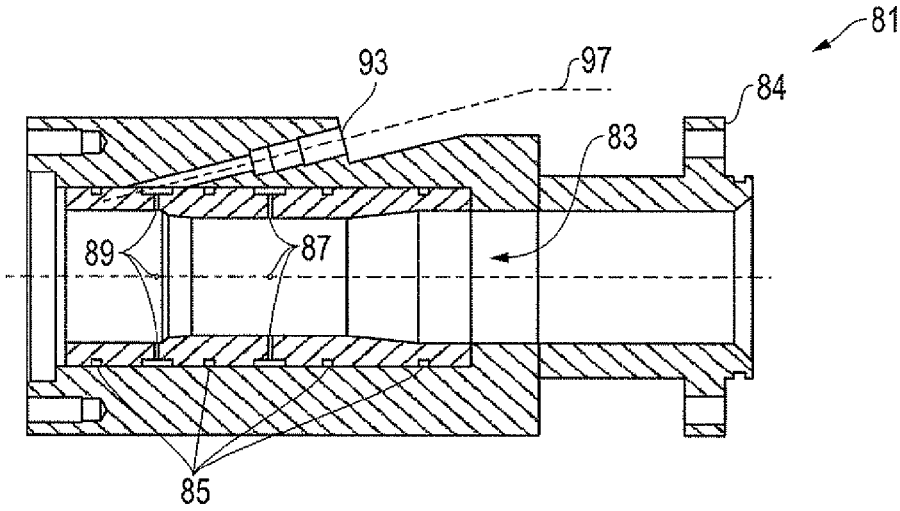

Referring now to FIGS. 6-8, a fourth embodiment of a pump discharge head 81 constructed in accordance with the invention is shown. The discharge head 81 has an internal venturi insert 83 that is effectively integral in assembly. This design permits the venturi insert 83 to be replaced after it has become worn by abrasive flow. As stated previously, other types of structures (e.g., orifice plate, flow nozzle) also may be used to cause the change in pressure.

ESP systems tend to produce fluid flows with high Reynolds numbers. In order to form a constant wave front, the venturi insert 83 is located downstream from the pump (e.g., attached to flange 84) at an axial distance that is at least three times the diameter from the last diffuser of the pump. A series of O-ring locations 85 on the outer surface of the venturi insert 83 isolate each of the independent sets of orifices 87, 89 to their respective static pressure ports 91, 93. In some embodiments, four orifices are formed in each set 87, 89 to allow the tool to be oriented in any direction without the detected pressures being affected by gravity. Separate hydraulic tubes 95, 97 communicate static pressure at ports 91, 93, respectively, to gauges located in the ESP assembly. This design greatly reduces cost for a downhole flowmeter as it permits the hydraulic pressures representing the flow as a component of an ESP system.

Inexpensive pressure sensors or traditional quartz sensors may be utilized within the gauge assembly. The inexpensive sensors are readily calibrated with each other when the pump is not in operation. In contrast, some prior art systems use differential pressure sensors which are far more sensitive and can easily burst at higher pressures and with fluctuations at the pump discharge. In another alternate embodiment, this venturi insert design may be incorporated into the downstream tubing string for existing or other types of pump assemblies where it would otherwise be incompatible.

In some embodiments, the invention may comprise down hole tool assemblies for wells other than an ESP assemblies (e.g., mud motors, etc.). The assembly may comprise a pump, a motor and a seal assembly mounted to and located between the pump and the motor. The pump discharge head may have a side wall and an integrally formed pump discharge pressure port extending directly through the side wall. The pump discharge head may be mounted directly to the pump and also has a sensor coupled to the pump discharge pressure port inside the pump discharge head for communicating information about conditions inside the pump to a gauge that is external to the pump. Production tubing may be mounted directly to the pump discharge head opposite the pump.

In alternate embodiments, the gauge may comprise a hydraulic gauge located below the motor opposite the pump discharge head. The pump discharge pressure port may communicate static fluid pressure via a hydraulic line to the hydraulic gauge to measure pressure at a discharge of the pump. The pump discharge pressure port may have a tubing connector for attaching hydraulic tubing thereto for connection to the gauge, and the pump discharge pressure port may extend at an acute angle relative to a longitudinal axis of the pump discharge head. The acute angle may comprise about 20 degrees, and further comprise a flow limiter located in the pump discharge pressure port for limiting a loss of fluid therethrough.

In still other embodiments, the pump discharge head may be threadingly coupled or bolted to the pump, and to the production tubing. The invention may further comprise a pressure change structure for measuring a pressure drop downstream from the pump. The pressure change structure may comprise one of a venturi, an orifice plate, and a flow nozzle. The pressure change structure may comprise a venturi insert that is replaceable after being worn by abrasive flow therethrough. Alternatively, the pressure change structure may be located downstream from the pump at an axial distance that is at least three times a diameter from a last diffuser of the pump.

In some embodiments, the pressure change structure may comprise a removable insert that is replaceable after being worn by abrasive flow therethrough. In addition, the removable insert may be incorporated into the production tubing. In some embodiments, the pump discharge head is the only component located between the pump and the production tubing, and in still other embodiments the pump discharge head is integrally formed with and directly incorporated in a housing of the pump.

The invention may further comprise a series of o-rings on an outer surface of the removable insert that isolate independent sets of orifices extending through the removable insert to respective static pressure ports. For example, four orifices may be formed in each set of orifices to permit orientation of the pressure change structure in any direction without detected pressure being affected by gravity Other advantages of the invention over current solutions include fewer necessary components to complete the assembly and provide a pressure tap for the gauge. The discharge head may comprise the only component located between the pump and the tubing, and the port is formed through the side wall of the discharge head itself. Moreover, the discharge head may be formed with or incorporated directly into the pump housing to further reduce the component count. Still other advantages include reduction in overall product cost, and a reduction in the number of sizes required for different applications.

While the invention has been shown or described in only some of its forms, it should be apparent to those skilled in the art that it is not so limited, but is susceptible to various changes without departing from the scope of the invention. For example, other types of sensors that measure fluid parameters also may be used in or in conjunction with the discharge head. Such sensors may be located at different points along the ESP string, or between components thereof. In addition to pressure ports and venturi devices, the invention may include electrical connections to the pump head (i.e., not just hydraulic), water cut sensors (e.g., sand detection), etc.

We claim:

1. A down hole tool assembly for a well, comprising:
- a pump;
- a motor;
- a seal assembly mounted to and located between the pump and the motor;
- a pump discharge head having a side wall, a production flow passage and an integrally formed pump discharge pressure port extending directly from the production flow passage through the side wall, the pump discharge head being mounted directly to the pump;
- a pressure gauge mounted below the motor;
- a hydraulic line extending alongside the pump, the seal assembly and the motor and connected between the pressure port and the gauge, the hydraulic line having a passage therethrough for communicating fluid in the discharge head to the gauge;
- the pump discharge head having an upper end configured to connect directly to production tubing; and
- wherein the pump discharge pressure port has a tubing connector for attaching the hydraulic line thereto for connection to the gauge, and the pump discharge pressure port extends at an acute angle relative to a longitudinal axis of the pump discharge head.

2. An assembly according to claim 1, further comprising a flow limiter located in the pump discharge pressure port for limiting a flow of fluid through the discharge pressure port.

3. An assembly according to claim 1, wherein the pump discharge head has a lower end threadingly coupled or bolted to the pump, and the upper end of the pump discharge head is adapted to be threadingly coupled or bolted to the production tubing.

4. A down hole tool assembly for a well, comprising:
- a pump;
- a motor;
- a seal assembly mounted to and located between the pump and the motor;
- a pump discharge head having a side wall, a production flow passage and an integrally formed pump discharge pressure port extending directly from the production flow passage through the side wall, the pump discharge head being mounted directly to the pump;
- a pressure gauge mounted below the motor;
- a hydraulic line extending alongside the pump, the seal assembly and the motor and connected between the pressure port and the gauge, the hydraulic line having a passage therethrough for communicating fluid in the discharge head to the gauge;
- the pump discharge head having an upper end configured to connect directly to production tubing; and
- a pressure change structure defining a reduced flow area section joining a larger flow area section within the production flow passage for creating a pressure drop downstream from the pump.

5. An assembly according to claim 4, wherein the pressure change structure comprises one of a venturi, an orifice plate, and a flow nozzle.

6. An assembly according to claim 4, wherein the pressure change structure comprises a venturi insert that is removable from the production flow passage.

7. An assembly according to claim 4, wherein the pressure change structure is located downstream from the pump at an axial distance that is at least three times a diameter from a last diffuser of the pump.

8. An assembly according to claim 4, wherein the pressure change structure is a removable insert located within the production flow passage.

9. An assembly according to claim 8, further comprising:
- a downstream pressure port extending through the side wall of the discharge head downstream of the first mentioned pressure port;
- an upstream orifice extending through a side wall of the insert and in fluid communication with the first mentioned pressure port;
- a downstream orifice extending through the side wall of the insert and in fluid communication with the downstream pressure port; and
- a seal ring on an outer surface of the removable insert that isolates the upstream and downstream orifices.

10. An assembly according to claim 9, further comprising:
- an annular upstream groove on the outer surface of the insert and joining the upstream orifice;
- an annular downstream groove on the outer surface of the insert and joining the downstream orifice; and
- the annular grooves permitting orientation of the insert in any direction relative to the discharge head.

11. An electrical submersible pump (ESP) assembly, comprising:
- a pump;
- a motor;
- a seal assembly mounted to and located between the pump and the motor:
- a pump discharge head having a side wall, a production flow passage, and an integrally formed pump discharge pressure port extending directly from the production flow passage through the side wall, the pump discharge head being mounted directly to the pump;
- production tubing mounted directly to the pump discharge head opposite the pump;

a hydraulic gauge located below the motor opposite the pump discharge head;

a hydraulic line extending alongside the pump, the seal assembly and the motor and connected between the pump discharge pressure port and the hydraulic gauge, the hydraulic line having a passage to communicate fluid from the production flow passage to the hydraulic gauge to measure pressure in the production flow passage; wherein the pump discharge pressure port has a tubing connector for attaching the hydraulic line thereto for connection to the gauge, and the pump discharge pressure port extends at an acute angle relative to a longitudinal axis of the pump discharge head; and a flow limiter is located in the pump discharge pressure port for limiting a flow of fluid through the pump discharge pressure port.

12. An assembly according to claim 11, wherein the pump discharge head is threadingly coupled or bolted to the pump and to the production tubing.

13. An assembly according to claim 11, further comprising:

a pressure change structure located in the production flow passage of the pump discharge head for creating a pressure drop in the pump discharge head, the pressure change structure having a larger flow area section joining a smaller flow area section; and the pressure change structure is a removable insert.

14. An assembly according to claim 13, wherein the pressure change structure comprises one of a venturi, an orifice plate, and a flow nozzle.

15. An assembly according to claim 13, wherein the pressure change structure is located downstream from the pump at an axial distance that is at least three times a diameter from a last diffuser of the pump.

16. An assembly according to claim 13, further comprising:

a downstream pressure port extending through the side wall of the discharge head downstream of the first mentioned pressure port;

an upstream orifice extending through a side wall of the insert and in fluid communication with the first mentioned pressure port;

a downstream orifice extending through the side wall of the insert and in fluid communication with the downstream pressure port;

a seal ring on an outer surface of the removable insert that isolates the upstream and downstream orifices

17. An electrical submersible pump (ESP) assembly, comprising:

a pump;

a motor;

a seal assembly mounted to and located between the pump and the motor;

a pump discharge head having a side wall, a production flow passage, and upstream and downstream pump discharge pressure ports extending from the production flow passage through the side wall, the pump discharge head being mounted directly to the pump;

a gauge assembly mounted below the motor;

a pair of lines, each connected between one of the pump discharge pressure ports and the gauge assembly, each of the hydraulic lines having a passage to communicate fluid from the production flow passage to the gauge assembly, the lines extending alongside the pump, the seal assembly and the motor;

a venturi sleeve removably located in the production flow passage of the pump discharge head, having a central flow passage with a smaller upstream diameter section joining a larger downstream diameter section;

an upstream communication port extending from the upstream diameter section through a side wall of the sleeve to the upstream discharge pressure port; and a downstream communication port extending from the downstream diameter section through the side wall of the sleeve to the downstream discharge pressure port.

* * * * *

UNITED STATES PATENT AND TRADEMARK OFFICE

CERTIFICATE OF CORRECTION

PATENT NO. : 8,328,529 B2
APPLICATION NO. : 12/362557
DATED : December 11, 2012
INVENTOR(S) : Joseph Scott Thompson et al.

It is certified that error appears in the above-identified patent and that said Letters Patent is hereby corrected as shown below:

In the Specifications:

Column 2, line 51, after "(ESP)" delete "11" and insert -- 11, which --

In the Claims:

Column 8, line 6, after "port;" insert -- and --
Column 8, line 8, after "orifices" insert a -- . --
Column 8, line 23, delete "hydraulic"

Signed and Sealed this
Twenty-third Day of April, 2013

Teresa Stanek Rea
*Acting Director of the United States Patent and Trademark Office*